US006575099B1

(12) United States Patent
Madison et al.

(10) Patent No.: US 6,575,099 B1
(45) Date of Patent: Jun. 10, 2003

(54) RAILWAY TIE INSERTION GUIDE

(75) Inventors: Harry Madison, Mt. Pleasant, SC (US); Jared Anderson, Sherburn, MN (US)

(73) Assignee: Harsco Technologies Corporation, Fairmont, MN (US)

( * ) Notice: Subject to any disclaimer, the term of this patent is extended or adjusted under 35 U.S.C. 154(b) by 0 days.

(21) Appl. No.: 10/010,642

(22) Filed: Nov. 5, 2001

(51) Int. Cl.[7] ..... E01B 29/06
(52) U.S. Cl. ..... 104/9
(58) Field of Search ..... 104/2, 9, 16

(56) References Cited

U.S. PATENT DOCUMENTS 3,698,324 A 10/1972 Peppin et al.
3,780,664 A 12/1973 Holley et al.
4,418,625 A * 12/1983 Allmer ..... 104/9
4,421,034 A * 12/1983 Allmer ..... 104/9
5,197,389 A 3/1993 Glomski et al.
5,907,914 A * 6/1999 Theurer ..... 104/2
6,158,353 A * 12/2000 Theurer ..... 104/16
6,170,401 B1 1/2001 Miller et al.

* cited by examiner

*Primary Examiner*—Mark T. Le
*Assistant Examiner*—Robert McCarry
(74) *Attorney, Agent, or Firm*—William F. Lang, IV; Eckert Seamans Cherin & Mellott, LLC

(57) ABSTRACT

A railway tie insertion system includes a guide plate having an easily adjustable height, and in many embodiments including a pair of side guides. The tie plate extends for substantially the entire distance between the rails, thereby minimizing the escape of ballast. During insertion of a tie, the tie guide plate and associated side guides provide guide surfaces along three sides of the inserted tie, thereby ensuring that the tie is inserted perpendicular to the pair of rails.

14 Claims, 5 Drawing Sheets

RAILWAY TIE INSERTION GUIDE

BACKGROUND OF THE INVENTION

1. Field of the Invention

The present application relates to a railway tie insertion guide for use with a tie insertion machine, and having a tie plate extending substantially across the entire distance between the tracks. The invention also relates to a method of inserting railway ties.

2. Description of the Related Art

Preparing a railway track frequently requires removal and replacement of the old railroad ties. Frequently, the new ties have slightly larger dimensions than the old ties, requiring either the use of a scarifying process (the use of reciprocating blades to widen the railway tie channel), or the use of higher pressure insertion tools.

One proposed method of inserting new railroad ties is to utilize a pantograph-type crane arm having a clamp mechanism at one end, with the crane arm being dimensioned and configured to push the old tie out from underneath the rails through the insertion of the new tie in the same location. Such mechanisms may include a hold down plate to bear against the top of the tie during insertion. Such systems may also include a guide sleeve through which the tie is passed prior to passing under the rails. A guide plate that provides guide surfaces on top on each side of the tie being inserted, positioned directly over the ballast and between the tracks, would likely provide more affective support and guidance for the tie as it is inserted.

Other proposed tie insertion systems include telescoping crane arms, dimensioned and configured to extend and retract parallel to the desired location of the tie. Such systems could also benefit from having an appropriate guide plate to provide guidance for the tie from directly over the ballast, between the tracks.

Accordingly, there is a need for a railway tie insertion system having a tie guide plate providing guidance along the top and both side surfaces of the railway tie throughout the entire insertion process. There is also a need for a railway tie guide plate having an easily adjustable height.

SUMMARY OF THE INVENTION

The present invention is a railway tie insertion guide for use in conjunction with a railway tie insertion vehicle.

The tie insertion guide includes a top guide plate, and a pair of side guides attached to the top plate, dimensioned and configured to fit against the top and both sides of a railway tie. The guide plate is mounted to a carrier frame, with a plurality of movable shims for setting the height of the guide plate with respect to the carrier frame. Shims may thereby be inserted or removed to set the working height of the carrier frame. Alternatively, the guide plate may be mounted to the carrier frame through the use of threaded rods and/or electronically controlled hydraulic cylinders, for setting the height of the guide plate with respect to the carrier frame.

The carrier frame is dimensioned and configured to reciprocate between a raised position wherein the carrier frame is stored, and a lowered position wherein it is used to guide the insertion of a tie. Preferred means for raising and lowering the carrier frame may include a pivoting arm, in conjunction with one or more hydraulic cylinders.

In use, when the tie insertion vehicle has stopped with the carrier frame and tie insertion arm directly above a tie that needs to be replaced, the guide plate is first lowered over the desired position. Next, the telescoping tie insertion arm is pivoted downward and extended, with the grasping portion closing around a new tie. The new tie is aligned with the channel within the ballast wherein the new tie will be located, and if a kicker and/or extractor has not been previously used to remove the old tie, the new itself will be utilized to push the old tie out of its channel. Retraction of the telescoping arm inserts the tie into the desired location in the ballast, below the guide plate. As the tie passed below the guide plate, the flat guide plate, dimensioned and configured to fit between the two rails, does not permit any significant escape of ballast at the end of the plate. Additionally, the side guides help to ensure that the tie is perpendicular to the rails.

It is therefore an aspect of the present invention to provide a railway tie guide plate dimensioned and configured to cover substantially all of the width between a pair of railroad tracks.

It is another aspect of the present invention to provide a railway tie insertion system wherein the tie is guided by a top and a pair of side guide surfaces throughout the entire insertion process.

It is a further aspect of the present invention to provide a railway tie insertion system wherein the height of the guide plate may be easily adjusted.

These and other aspects of the present invention will become apparent through the following description and drawings.

BRIEF DESCRIPTION OF THE DRAWINGS

Like reference numbers denote like elements throughout the drawings.

DETAILED DESCRIPTION

The preferred embodiment of the present invention is a railway tie insertion guide for use in conjunction with a railway tie insertion vehicle for inserting new railway ties within the channels in the ballast left by removal of the old ties. The invention is best understood through a description of a typical railway tie insertion vehicle, serving as an example of a vehicle with which the present invention may be used. For purposes of this specification, horizontal is defined as substantially parallel to the ties, and vertical is defined as substantially perpendicular to the ties.

Figure 1:
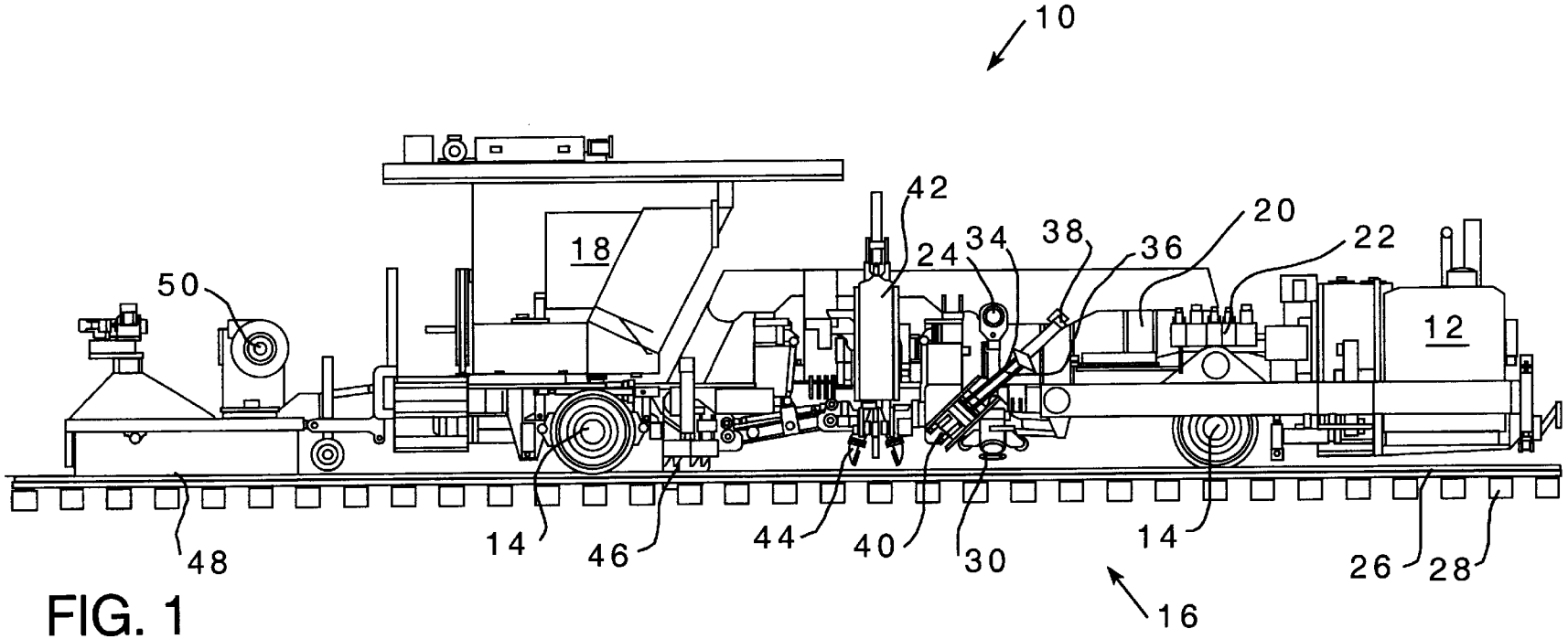
FIG. 1 is a side view of a tie insertion vehicle for which the present invention will be utilized.

FIG. 1 illustrates a railway tie insertion vehicle 10. The tie insertion vehicle 10 includes an engine 12 for moving the vehicle 10 and supplying power to its various components, a plurality of wheels 14 for moving the vehicle 10 along the tracks 16, and an operator's cab 18 from which the vehicle 10 and its various components are controlled. The engine 12 supplies power for operation of the hydraulic power system utilized to operate the various components of the vehicle 10, with the hydraulic power system including a hydraulic fluid storage cylinder 20, operatively connected with a plurality of valves 22 for channeling the hydraulic fluid to the various components of the vehicle 10.

Figure 3:
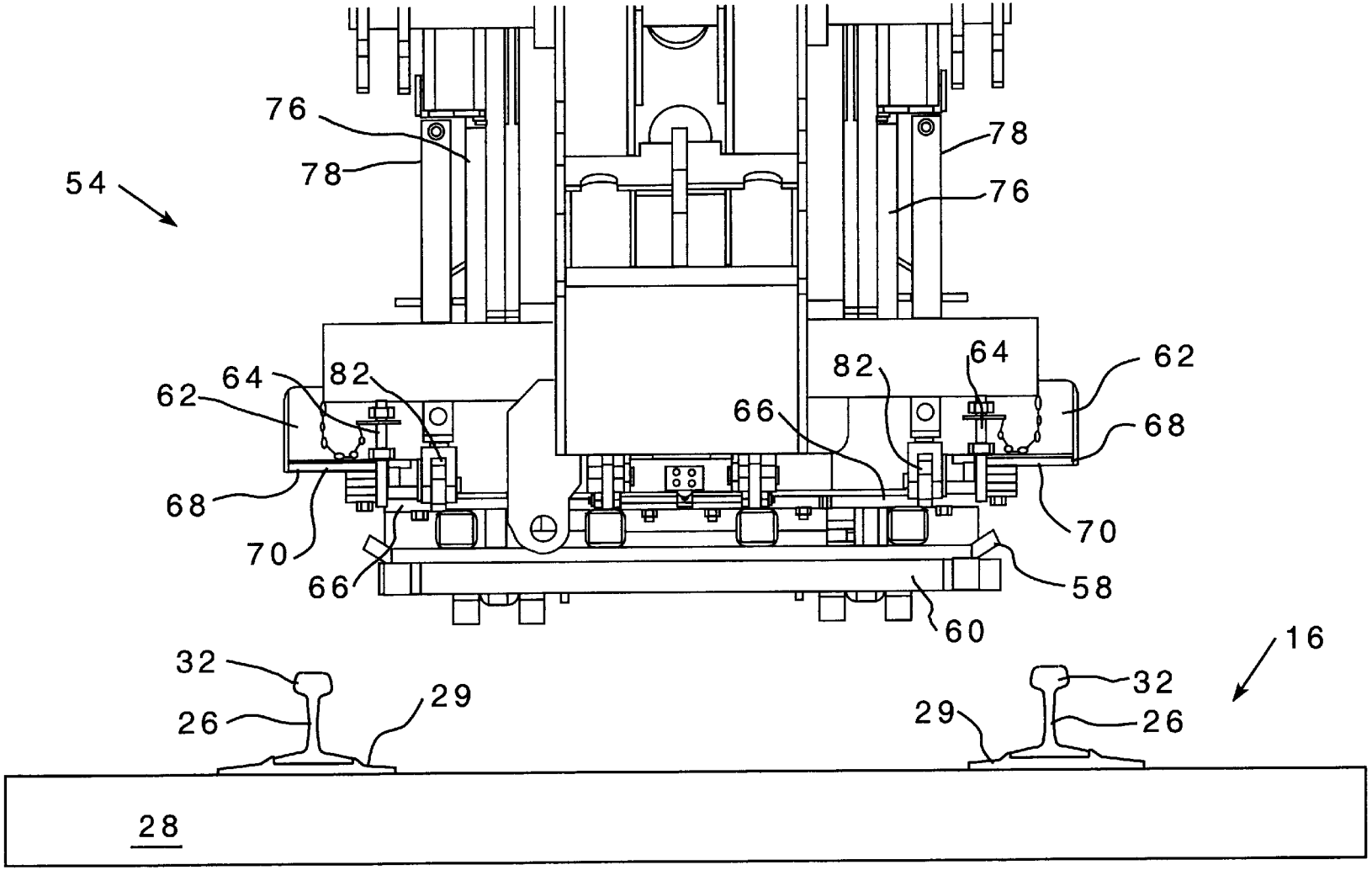
FIG. 3 is a front view of a tie guide apparatus according to the present invention, in its raised position.

The vehicle 10 includes a pair of rail clamps 24, dimensioned and configured to lift the rails 26 of the tracks 16 sufficiently to permit insertion and removal of the ties 28 beneath the rails 26 and tie plates 29, supporting the rails 26 on the ties 28. The rail clamp 24 includes a plurality of rollers 30 at the bottom end of a pair of scissor arms 31, dimensioned and configured to grab the rail 26 from both sides beneath the rail's ball 32 (best illustrated in FIGS. 3 and 5). In use, the rollers 30 will be placed on either side of the rails 26, beneath the ball 32, and the rail clamp 24 will be raised, causing the scissor arms 31 to tighten around the rail 26, and enabling the rail clamp 24 to deflect the rail 26 upward, typically approximately 1–2 inches. The rollers 30 permit the rail clamp 24 to remain clamped to the rail 26, raising the rail 26 upward, as the vehicle 10 moves forward from tie 28 to tie 28 along the track 16.

A tie kicker 34 is located near the rail clamp 24. The tie kicker 34 includes an arm 36 having a striking plate 38 at one end, which is pivotally secured to the vehicle 10 at its other end 40. In use, the arm 36 will pivot around the point 40 so that the striking plate 38 strikes a tie 28, thereby pushing the tie 28 partially out from underneath the rails 26 and out from the ballast surrounding the tie 28. The tie kicker 34 is used in conjunction with the tie boom 42 to remove old ties.

The tie boom 42 includes multiple telescoping sections, and terminates in a tie clamp 44, dimensioned and configured to grasp a tie 28. An example number of telescoping sections for the tie boom 42 is three, with these three sections extending horizontally, substantially parallel to the ties 28. The tie clamp 44 is dimensioned and configured to be raised and lowered between a raised travel position and a lowered position wherein a tie 28 may be grasped. The tie boom 42 may be used to either insert new ties, or to remove old ties. To remove an old tie, the tie boom 42 is extended so that the tie clamp 44 is positioned above a portion of the tie 28 that may easily be grasped, the tie clamp 44 is lowered and closed around the tie 28, and the tie boom 42 is then extended outward to slide the old tie 28 out from underneath the rails 26, in a direction substantially parallel to the rail 28. The old tie 28 may then be released by the tie clamp 44, and left along side the track for later disposal. To insert a new tie, the tie boom 42 is first extended outward to a position wherein the tie clamp 44 is substantially directly above a new tie 28, previously deposited along side the track 16. The tie clamp 44 is lowered to a position wherein it may grasp the tie 28. After the tie 28 is grasped, the tie clamp 44 is raised to a position wherein the tie 28 is aligned with a channel in the ballast surround the ties that has been left by removal of the previous tie, and the tie boom 42 is retracted to insert the new tie 28 underneath the tracks 26.

The vehicle 10 also may include a ballast plow 46, which may be lowered onto the tops of the ties 28 for removing ballast displaced during the tie insertion process, and/or a tie broom 48, which may include a suction apparatus 50, also for removing displaced ballast from the rails 26 and ties 28.

Railway ties that have been in use for many years tend to be bent or otherwise deformed from the various stresses placed on them. Additionally, it may be desirable to utilize a slightly larger replacement tie than was originally used. Therefore, the process of inserting a new tie into the channel left by an old, removed tie, will require a great deal of force to overcome any ballast blocking the path of the new tie, and will displace a substantial amount of ballast. There is also a tendency for the newly inserted tie to deflect upward during insertion, thereby striking the rail 26 on the far side of the track 16 instead of passing under this rail. The present invention is directed towards maintaining proper alignment of a new tie 28 during insertion of the tie 28 under the rails 26, and towards directing displaced ballast out the opposite end of the ties channel, instead of upward and onto the rails.

Figure 2:
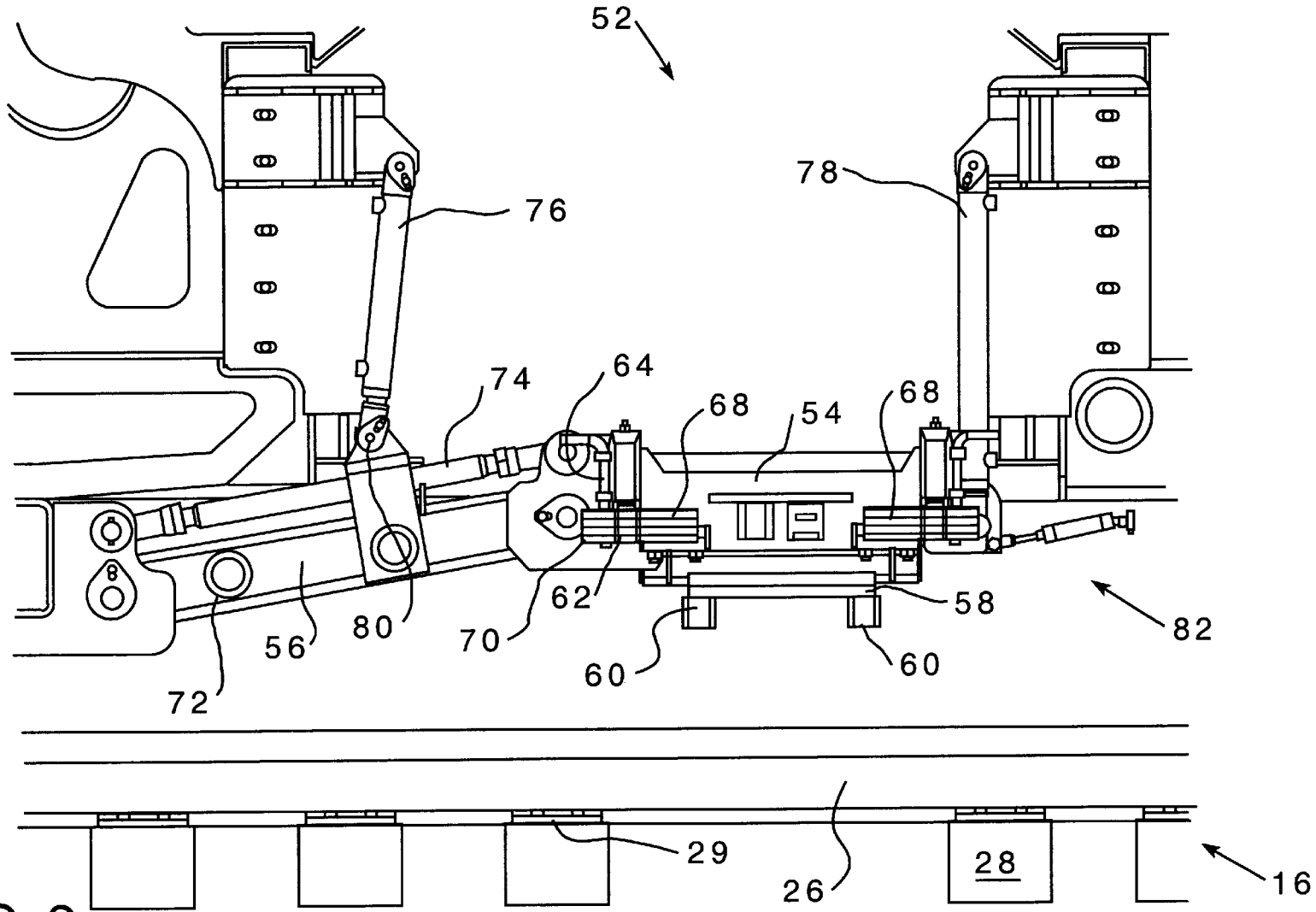
FIG. 2 is a side view of a tie guide apparatus according to the present invention, in its raised position.

Referring to FIG. 2, the tie insertion guide 52 includes a carriage 54 at one end of a positioning arm 56. The carriage 54 includes a guide plate 58, which is preferably a substantially horizontal plate having a substantially flat bottom, and which extends across substantially the entire distance between the two rails 26 (best illustrated in FIGS. 3–5). The guide plate 58 may include a pair of substantially parallel side guides 60, dimensioned and configured to fit on either side of the tie 28, and substantially parallel to the final desired position of a tie 28 underneath the tracks 26. The carriage 54 may include means for adjusting the height of the guide plate 58 with respect to the carriage 54. In the illustrated example, the carriage includes a pair of shim holders 62, dimensioned and configured to contain a plurality of removable shims, with the shims secured in place by a pin 64. By inserting and removing some of the shims 68 between the carriage 54 and the top 66 of the guide plate 58, the height of the guide plate 58 with respect to the carriage 54 may be adjusted, so that for a given height of rail 26, when the bottom 70 of the shim holders 62 rests on the ball 32 of the rails 26, the guide plate will be substantially coplanar with the bottom of the rails 26. Other alternative means of adjusting the height of the guide plate 58 with respect to the carriage 54 may be used, for example, threaded rods or electronically positioned hydraulic cylinders.

Figure 4:
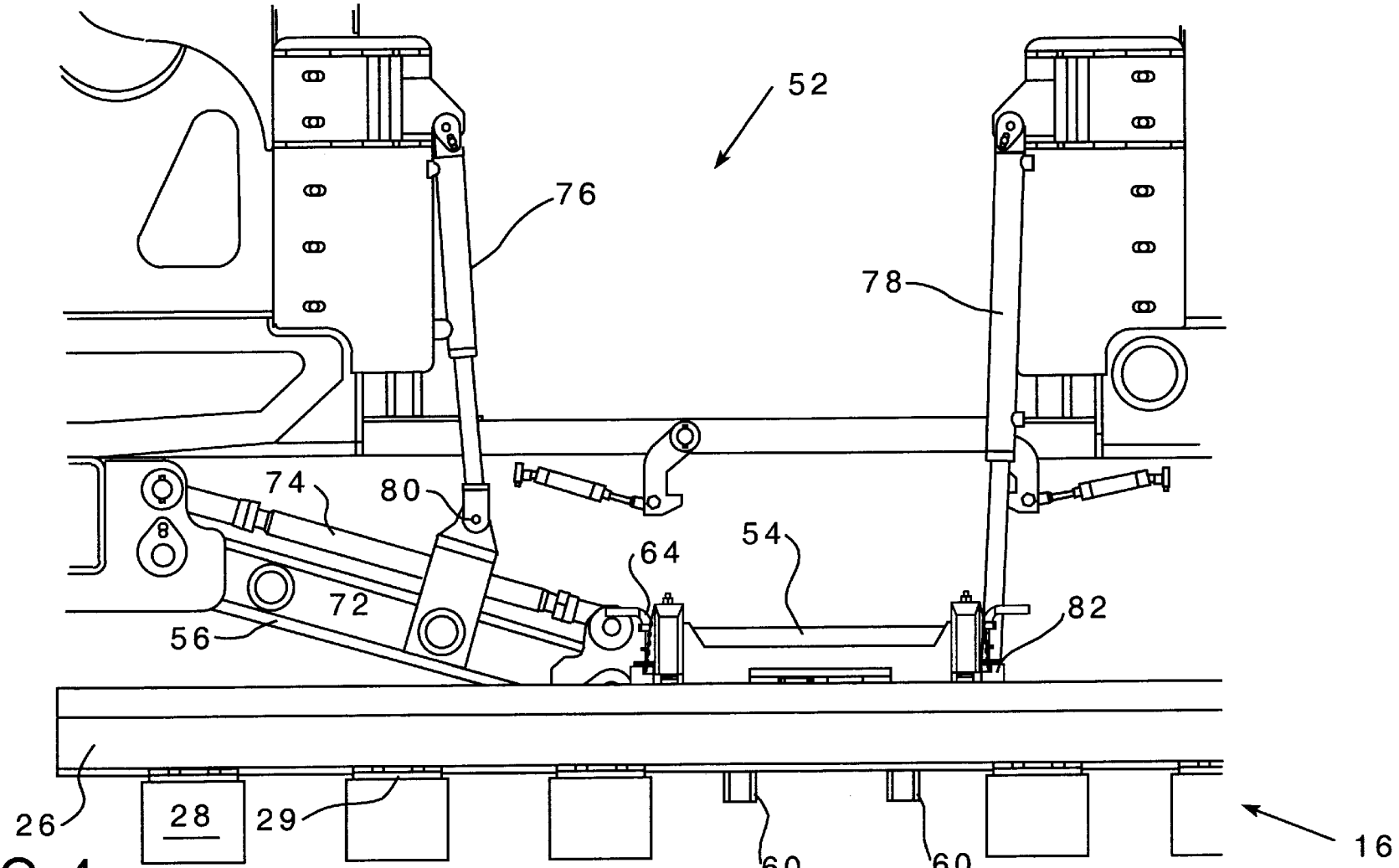
FIG. 4 is a side view of a tie guide apparatus according to the present invention, in its lowered position.
Figure 5:
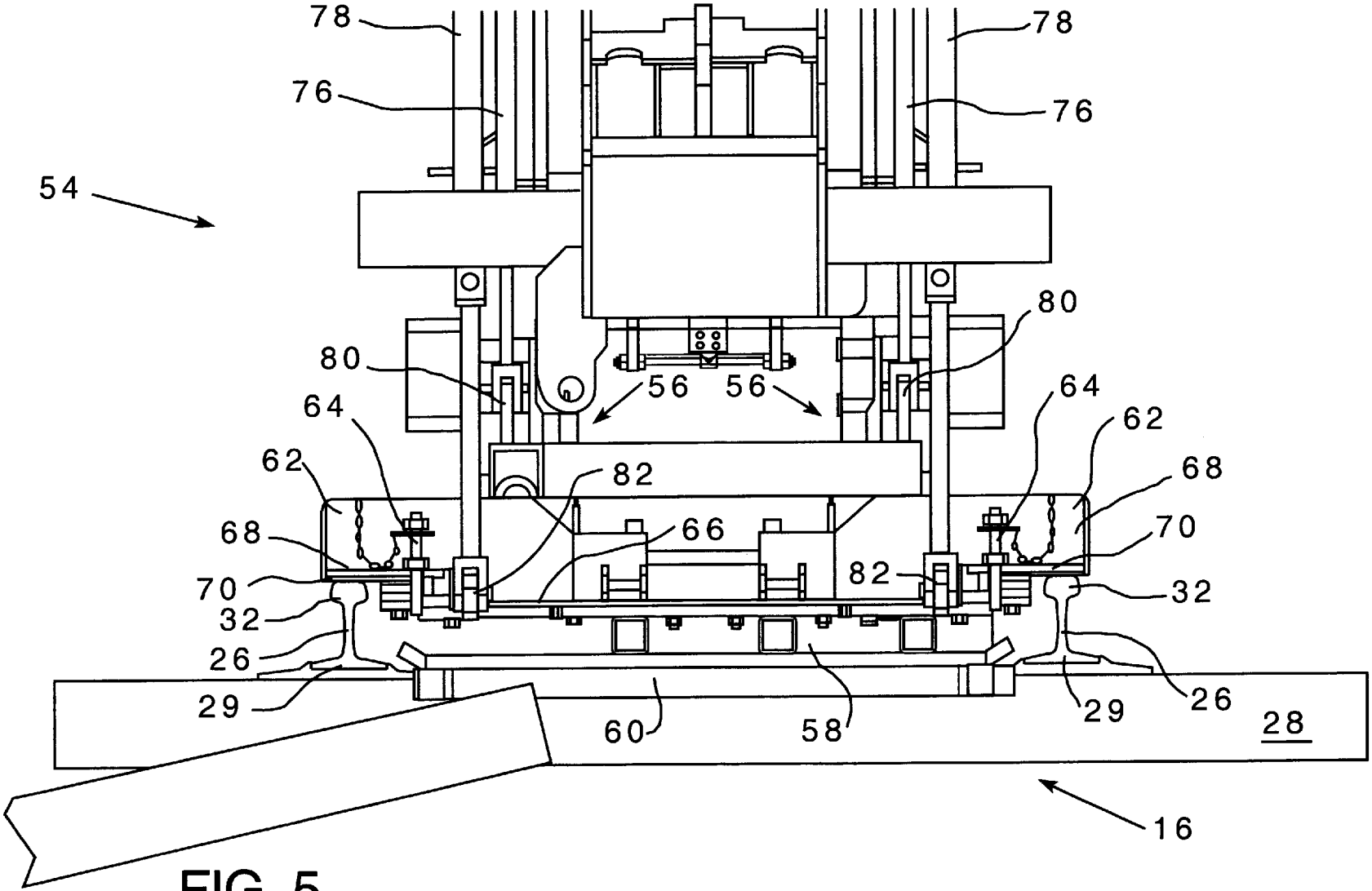
FIG. 5 is a front view of a tie guide apparatus according to the present invention, in its lowered position.

The positioning arm 56 is dimensioned and configured to guide the movement of the carriage 54 between a raised, travel position (FIGS. 2–3), and a lowered, working position (FIGS. 4–5). This may be accomplished by a positioning arm having four elongated, substantially parallel members, pivotally secured to the carriage 54 at one end and to the tie insertion vehicle 10 at the opposite end. Two of the four arm members, in the illustrated example the bottom two members, will be support members 72, having a fixed length. The arm 56 preferably also includes a pair of guide members 74, in the present example the top two members of the arm 56. The guide members 74 preferably have an adjustable length. The use of the fixed length support members 72, and adjustable length guide members 74, permits the carriage 54 to remain substantially horizontal whether in its raised position, lowered position, or anywhere in between.

The tie insertion guide also includes means for raising and lowering the carriage 54, which in the present example are at least two hydraulic cylinders 76, 78. At least one hydraulic cylinder 76 and in the illustrated example two hydraulic cylinders 76 are pivotally secured between the tie insertion vehicle 10 and the arm 56 at point 80. Likewise, at least one hydraulic cylinders 78 is pivotally secured between the tie insertion vehicle 10 and the carriage 54 at the carriage's side 82, opposite the arm 56. In the illustrated example, two hydraulic cylinders 78 are used.

In use, the carriage 54 will remain in its upward position (FIGS. 2–3) until it is desired to insert a new tie 28. The tie boom 42 will grasp the new tie 28, and align it with a channel within the ballast left by removal of an old tie as described above. The carriage 54 will be lowered from its raised position to its lowered position (FIGS. 4–5), wherein the bottom 70 of the shim holder 62 will contact the ball 32 of the rail 26, thereby locating the bottom of the guide plate 58 substantially coplanar with the bottom of the rail 26. The tie boom 42 will then insert the tie 28 in the appropriate location underneath the guide plate 58, with the guide plate 58, and if present, the side guide 60, ensuring that the rail remains properly aligned, substantially perpendicular to the tracks 26, and at the appropriate height to pass underneath the rail 26. Because the guide plate 58 extends substantially across the entire distance between the rails 26, ballast displaced by insertion of the tie will be forced out the opposite end of the channel within the ballast. Once the tie is inserted, it will be released by the tie boom 42, the carriage 54 may be raised (FIGS. 2–3), and the tie insertion vehicle 10 may proceed to the next location wherein a tie must be replaced.

Alternatively, the tie insertion guide 52 may be used with other tie insertion-removal vehicles, for example, a vehicle adapted to grasp the tie plate 29, remove the old tie 28, and insert a new tie 28.

While a specific embodiment of the invention has been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the appended claims and any and all equivalents thereof.

What is claimed is:

1. A railway tie insertion guide, the railway rails being substantially parallel and defining a distance therebetween, said railway tie insertion guide comprising:

a carriage moving between a lowered position and a raised position; and a substantially horizontal guide plate, dimensioned and configured to extend substantially across the distance between said rails, said guide plate having a substantially flat bottom surface, said guide plate being vertically positionable within said carriage, said guide plate being dimensioned and configured to guide a railway tie during insertion of the tie beneath a pair of railway rails.

2. The railway tie insertion guide according to claim 1, further comprising:

a plurality of removable shims between said guide plate and said carriage, said shims being dimensioned and configured to resist downward movement of said guide plate with respect to said carriage, said plurality of shims further defining an aperture dimensioned and configured to receive a pin; and a removable pin fitting within said aperture.

3. The railway tie insertion guide according to claim 1, further comprising an arm pivotally secured at one end to said carriage, said arm being dimensioned and configured to move said carriage between said raised position and said lowered position, and to resist upward movement of said carriage when said carriage is in said lowered position.

4. The railway tie insertion guide according to claim 3, wherein said arm further includes at least one support member having a fixed length, and at least one guide member having an adjustable length.

5. The railway tie insertion guide according to claim 4, further comprising a first hydraulic cylinder dimensioned and configured to actuate movement of said arm, and to resist upward movement of said carriage when said carriage is in said lowered position.

6. The railway tie insertion guide according to claim 3, further comprising a second hydraulic cylinder dimensioned and configured to actuate movement of said carriage, and to resist upward movement of said carriage when said carriage is in said lowered position.

7. The railway tie insertion guide according to claim 1, further comprising a pair of substantially parallel side guides extending generally downward from said guide plate's bottom surface, said side guides being dimensioned and configured to receive a railway tie therebetween.

8. A railway tie insertion guide, the railway rails being substantially parallel and defining a distance therebetween, said railway tie insertion guide comprising:

a carriage;

a substantially horizontal guide plate, dimensioned and configured to extend substantially across the distance between said rails, said guide plate having a substantially flat bottom surface, said guide plate being vertically positionable within said carriage, said guide plate being dimensioned and configured to guide a railway tie during insertion of the tie beneath a pair of railway rails; and means for moving said carriage between a lowered position and a raised position, and for resisting upward movement of said guide plate in said lowered position.

9. The railway tie insertion guide according to claim 8, further comprising means for providing lateral guidance for the railway tie during insertion.

10. The railway tie insertion guide according to claim 9, wherein said comprising means for providing lateral guidance for the railway tie include a pair of substantially parallel side guides extending generally downward from said guide plate's bottom surface.

11. The railway tie insertion guide according to claim 8, wherein said means for moving said carriage between said lowered position and said raised position, and for resisting upward movement of said guide plate in said lowered position, include an arm pivotally secured at one end to said guide plate.

12. The railway tie insertion guide according to claim 11, wherein said arm further includes at least one support member having a fixed length, and at least one guide member having an adjustable length.

13. The railway tie insertion guide according to claim 12, further comprising a first hydraulic cylinder dimensioned and configured to actuate movement of said arm, and to resist upward movement of said carriage when said carriage is in said lowered position.

14. The railway tie insertion guide according to claim 11, further comprising a second hydraulic cylinder dimensioned and configured to actuate movement of said carriage, and to resist upward movement of said carriage when said carriage is in said lowered position.

* * * * *